US006494817B2

(12) United States Patent
Lake

(10) Patent No.: US 6,494,817 B2
(45) Date of Patent: Dec. 17, 2002

(54) PORTABLE EXERCISING DEVICE

(76) Inventor: Victoria Jo Whited Lake, 2205 Queen Anne Ct., Dunwoody, GA (US) 30350

( * ) Notice: Subject to any disclaimer, the term of this patent is extended or adjusted under 35 U.S.C. 154(b) by 25 days.

(21) Appl. No.: 09/788,731

(22) Filed: Feb. 20, 2001

(65) Prior Publication Data

US 2002/0119869 A1 Aug. 29, 2002

(51) Int. Cl.[7] ..... A63B 21/06; A63B 21/04
(52) U.S. Cl. ..... 482/93; 482/129; 482/904
(58) Field of Search ..... 482/93, 129, 132, 482/141, 121–126, 63, 35–39, 87, 904, 116, 131, 95

(56) References Cited

U.S. PATENT DOCUMENTS 4,747,594 A * 5/1988 Houde ..... 482/72
5,176,602 A * 1/1993 Roberts ..... 482/131
5,385,525 A * 1/1995 Davis ..... 482/121
5,468,205 A * 11/1995 McFall et al. ..... 482/129
5,766,118 A * 6/1998 Conner ..... 482/129
5,820,529 A * 10/1998 Weintraub ..... 482/92
5,839,994 A * 11/1998 Elbogen ..... 482/91
5,871,424 A * 2/1999 Conner ..... 482/129
6,113,564 A * 9/2000 McGuire ..... 602/32

* cited by examiner

*Primary Examiner*—Michael A. Brown
*Assistant Examiner*—Lori Baker Amerson
(74) *Attorney, Agent, or Firm*—William B. Noll

(57) ABSTRACT

A portable and personal exercising device that may be stored and transported as a kit of intermatable components, then readily assembled and removably secured to a hinged door of a structure. The kit essentially comprises three telescopically engaging cylindrical members, where a pair of the members mount pulleys, a sliding weight member for vertical movement along the mated cylindrical members, and a cable in cooperation with the pulleys sliding weight member to effect such vertical movement by the person seeking exercise.

5 Claims, 3 Drawing Sheets

PORTABLE EXERCISING DEVICE

FIELD OF THE INVENTION

This invention is directed to the field of portable exercising devices, more particularly to a personal exercising device that may be readily assembled and disassembled, and placed in a kit or convenient carrying case for easy transport.

BACKGROUND OF THE INVENTION

The present invention relates to a personal and portable exercising device that may be conveniently transported to different sites by the easy disassembly thereof and placed in a carrying case. As is known, various types of exercising devices are popular in today's society. In recent decades, as the awareness of the importance of cardiovascular and muscle training has risen, so too has the demand for increased and improved excercise equipment. While gyms and health clubs typically offer a variety of sophisticated and expensive equipment, such clubs are often undesirable because of distance from the user or high membership fees. And, even those who are members of such a facility do not always have the time or energy to visit the club, even when a workout is desired or needed. Further, the public has become more aware that consistent and intelligently applied exercise can lengthen life span, overcome physical dysfunction and provide other related advantages.

Exercising the muscles of the body to increase the strength, muscle size and fitness of an individual by lifting free weights or by using a system of cables and pulleys to lift weights is one of the types of known portable exercising devices. It was found that free weights were cumbersome, created storage problems, can be noisy, damaging to floors and walls, and are heavy limiting portability and increasing shipping cost. The development of devices that used springs or elastic bands to provide the resistance to muscle contraction eliminated the problems inherent with handling heavy weights, but created new problems and were limited to one point of resistance further limiting versatility in types of exercises capable of being performed.

The prior art, as reflected in the following U.S. patents, illustrate and describe a number or personal or portable exercising devices, namely:

a.) U.S. Pat. No. 5,871,424, to Connor, teaches an exercise apparatus having a clamping means for securing the apparatus to a conventional door, at least one elastic resistance band and a flexible resistance harness. The resistance harness includes a pair of arm slings made of a thin, relatively wide fabric material formed in a closed loop and defining an opening therethrough. The resistance harness further includes a connecting strap made of a thin, relatively narrow fabric material and having opposed ends. The opposed ends of the connecting strap are attached to the pair of arm slings such that the arm slings are connected by the connecting strap. The resistance harness further includes a chest strap made of a thin, relatively narrow fabric material and having opposed ends. The opposed ends of the chest strap are attached to the pair of arm slings opposite the connecting strap. The exercise apparatus is compact and lightweight and thus is convenient for individuals who travel frequently to use, transport and store. In a preferred method of using the exercise apparatus, a user extends the upper arms through the arm slings of the resistance harness and pulls the resistance harness using the abdominal muscles in the direction of the pelvis while bowing the lower back outwardly to extend the resistance band. Thus, the spine is elongated and all of the abdominal muscle groups are contracted without placing undue stress on the muscles in the lower back.

b.) U.S. Pat. No. 5,820,529, to Weintraub, relates to a dual operational exercise resistance device that is usable in the home or fitness center by attachment to a supporting structure. The supporting structure can be a freestanding platform base, a wall, or a door. The device can be utilized to replace the weight stack in a universal gym or any exercise machine. The device can be utilized to provide resistance from more than one point of attachment for standard exercise grips. In addition the resistance provided by the device is easily adjustable, providing the appropriate resistance for the particular muscle group being exercised. The device comprises a base that is configured for attachment to a support or exercise machine, a lever arm member having a peripheral edge being pivotally attached to the base having a pulley on end, two pulleys on opposite ends of the base being pivotally mounted on a horizontal axis within vertically orientated mounted brackets and a pulley being pivotally attached to an intermediate point on the base. One end of the lever arm member is attached to a pivotally mounted pulley to which a portion is engaged by a cable and extends therefrom in two directions for attachment to a grip at two alternate locations. To the other end of the bar attached a resistance mechanism that attaches pivotally to an intermediate point on the base. This structure reduces the resistance force produced by the resistance mechanism as the exerciser approaches full contraction of the muscle group being exercised to insure a completely full contraction is made. The device also compensates for the use of a non-linear resistance mechanism.

c.) U.S. Pat. No. 5,766,118, to Connor, describes an exercise apparatus that includes a clamping means for fixing the apparatus to a vertical surface such as a door or a wall, an elastic resistance band and a resistance harness. In a preferred embodiment, the clamping means includes a lag screw having a hook portion adjacent one end. One end of the resistance band is attached to the hook portion of the lag screw and the other end is attached to the resistance harness. In another preferred embodiment, the exercise apparatus further includes an adjustment means for adjusting the vertical location of the resistance harness relative to the clamping means, and the clamping means includes a U-shaped Bracket. The adjustment means includes a belt having one end attached to the U-shaped bracket, and the free end threaded first through an adjustment buckle and then through a hook attached to one end of the resistance band. The other end of the resistance band is attached to the resistance harness. In a preferred method of using the exercise apparatus, a user extends the upper arms through an opening defined by the resistance harness and rotates the upper body about the pelvis while pulling the resistance harness in the direction of the pelvis using the abdominal muscles to extend the resistance band. In another preferred method, the user pulls on the resistance harness in the direction of the pelvis using the abdominal muscles to extend the resistance band without rotating the upper body about the pelvis. Thus, the spine is elongated and all of the abdominal muscle groups are contracted without placing undue stress on the muscles in the lower back.

d.) U.S. Pat. No. 5,468,205, to McFall et al., discloses an exercise apparatus having a pair of pulley support units mounted on a door by straps which vertically encircle the door. The support units are interconnected by a series of elastic bands, such as bungee cords that run vertical paths between the support units. The ends of the bands or cords are wrapped around pulleys and terminated such that a handle may be attached to each of the cords at either the top unit or the bottom unit. Various exercises are possible with one or two arms or legs by pulling on the cords with the handle. The apparatus is easily mounted or dismounted from any door or other vertically oriented and fixed-in-place partition and is small enough to fold and store in a small carrying case.

e.) U.S. Pat. No. 4,747,594, to Houde, is directed to a portable exercise device for use in a doorway, and includes a base with a pair of arms pivotally connected thereto for rotation between a vertical storage position and a horizontal position in which they engage the sides of the opening. Additionally, adjustable brackets on the outer ends of the arms are provided for centering and securing the base in the opening; a central, multi-section post for mounting in a sleeve on the base and for connection to a top bracket for securing the top of the post to the top of the opening. Further, a pair of multi-section columns for mounting in sockets on the base and connection to the top brackets are provided with a pair of spring assemblies connected to the base and slidable on the columns; and pulleys mounted on the top ends of the columns and near the bottom end of the posts. Finally, a cable extends around the pulleys to seat which is slidably mounted on a bar, one end of which is removably mounted in a socket on the base, the bar extending outwardly from the post.

A daily or regular regimen of exercising is extremely important to one's health. However, one further disadvantage with traditional personal exercising devices, such as those of the prior art, particularly in today's mobile society, is the inability or difficulty in transporting the devices when one must be away from home or office where the devices are typically used. As a consequence the regimen is broken. This is comparable to one taking a break from one's dietary schedule. Obviously, the intended results of such schedule may never be reached. The present invention comprises a portable device that allows the user to readily transport the device so that the chosen exercising regimen may be continued at home, office, vacation or a trip. This is accomplished by a unique device that can be readily assembled, disassembled, and transported in a convenient carrying case of the component parts. The manner by which this invention achieves the goals hereof will become apparent in the description which follow, particularly when read in conjunction with the accompanying drawings.

SUMMARY OF THE INVENTION

The present invention teaches a personal and portable exercising device that comprises plural intermatable components for easy assembly and mounting to a door, then disassembled for packing and storing in a convenient carrying case or kit for transport to another location and set up to be used again.

The device hereof comprises a first cylindrical, elongated component mounting at a first end a U-shaped hook for removably overriding the top of a door, for example, a diametrically reduced second end, and an adjustable pulley member along the elongated member. A second or intermediate component thereof is a cylindrical member having a first end for telescopically engaging the reduced diametrical second end of the first cylindrical component, a second diametrically reduced second end, and a sliding weight member capable of sliding movement along the lengths of the first and second components through a manual effort by the user thereof. A third and final component comprises a cylindrical member for telescopically engaging the second diametrically reduced second end of the intermediate component, where said third component mounts a pair of pivotal arms, at which at least one said arm is adjustable for removably securing to opposing sides of the door, and a bracket mounting a pulley. Finally, the device includes a manually movable cord having a free end secured to the sliding weight member via the respective pulleys. By adding to or releasing weights from the sliding weight member, the user can readily develop an exercising regimen for daily or regular use, and to maintain same whether at home, office, trip or vacation.

Accordingly, an object of this invention is to provide an exercising device that may be readily assembled and disassembled for use at the pleasure of the user wherever desired.

Another object hereof is the provision of a kit of components forming the exercising device of this invention, where the disassembled device may be readily transported to different locations by the user to ensure the maintenance of a regular exercising regimen irrespective of where the user may be.

A further object of the invention is an exercising device that can be easily and removably attached to a hinged door of a structure.

These and other objects of this invention will become more apparent, particularly to those skilled in the art, in the description and drawings which follows.

DETAILED DESCRIPTION OF PREFERRED EMBODIMENT

Figure 1:
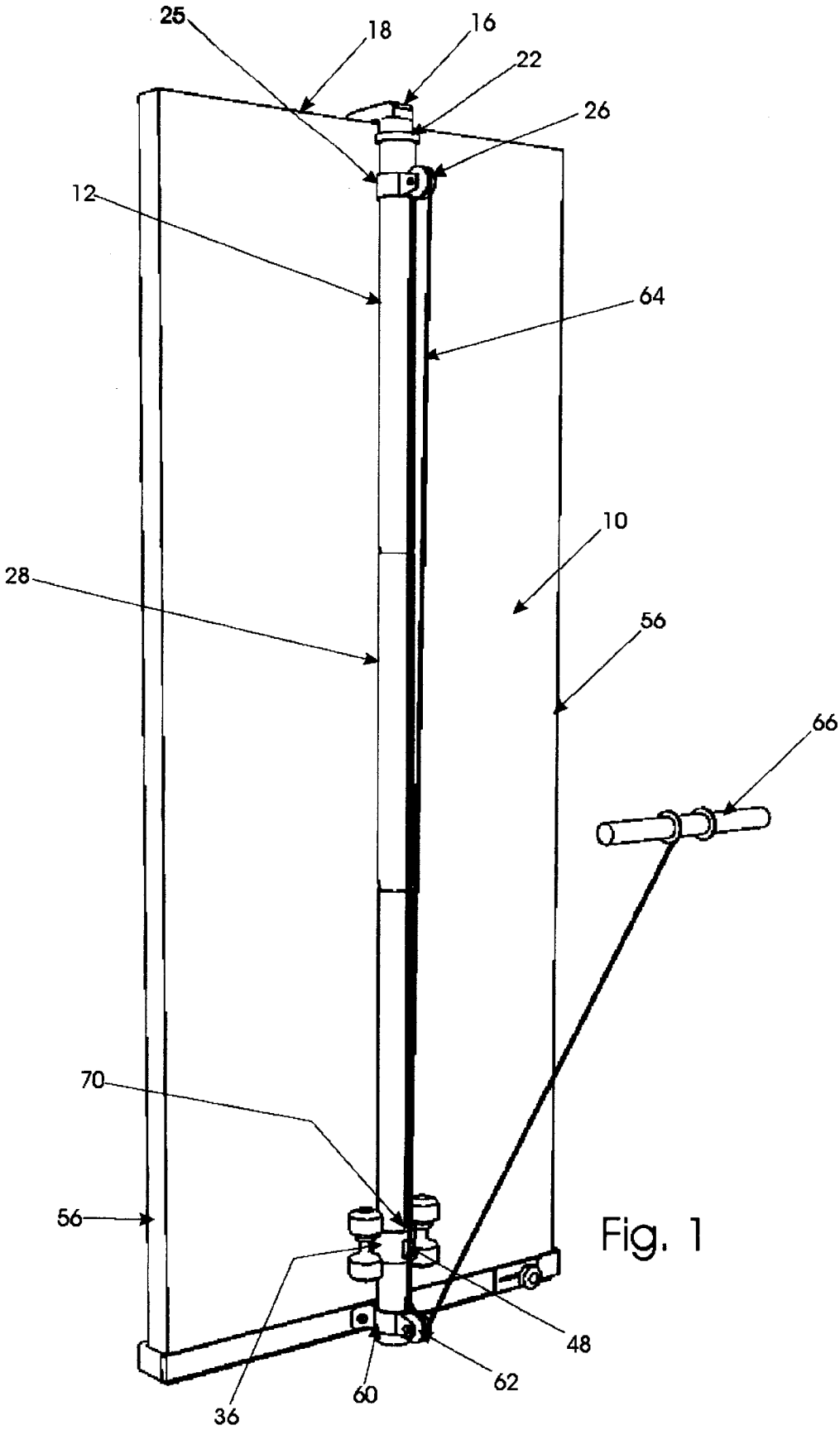
FIG. 1 is a perspective view of the personal and portable exercising device of this invention showing the operating mode for the device mounted to a hinged door of a structure, such as in one's home.

The present invention is directed to a personal and portable exercising device that may be readily assembled on a hinged door of a structure, such as at home, office, or hotel, disassembled and transported to selected locations for exercising by the user. The device will now be described with regard to the several Figures, where like reference numerals represent like components or features throughout the various views.

Figure 2:
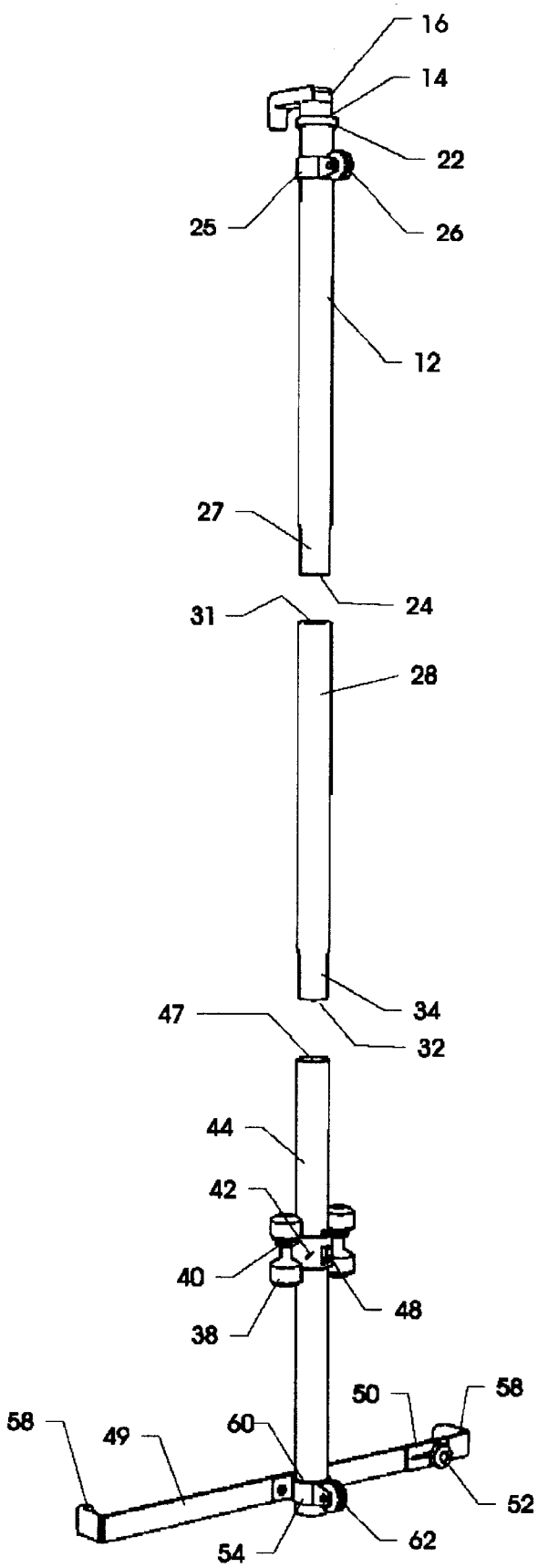
FIG. 2 is an exploded perspective of the exercising hereof, illustrating the various intermatable components thereof.

Turning first to FIGS. 1 and 2, the exercising device 10 of this invention comprises a first cylindrical member 12 of a uniform and predetermined diameter, fabricated of aluminum or plastic tubing, having a first end 14 that includes a J-shaped hook 16 to override the top 18 of the door 20, a slide stop 22 in the form of a flanged ring, a pulley bracket 25 mounting a rotatable pulley 26, and a second end 24 having a reduced diametrical portion 27, which as explained later is for telescopically engaging a second, cylindrical or intermediate member 28. The second member 28, comprises a body portion 30 of a diameter comparable to said predetermined diameter, where a top end 31 telescopically receives said reduced diametrical portion 27, and a lower end 32 with a reduced diametrical portion 34. For sliding movement along said first and second cylindrical members 12, 28, is a sleeve 36 to which may be removably secured one or more weights 38 by means of a comparable number of laterally extended arms 40. In operation the sleeve is free to move vertically, up to the slide stop 22, however, for storage convenience the sleeve 36 may include a manually activated, thumb screw 42 to temporarily secure the sleeve to the body portion 30.

A final or third structural component 44 consists of a tubular body member 46, of said predetermined diameter, having a top end 47 for telescopically receiving the reduced diametrical portion 34, mounting an open cable guide 48, and a pair of pivotal arms 49, where at least one of said arms 49 is adjustable by a telescoping slide 50 having a thumb screw 52 to temporarily secure the slide 50 to its corresponding arm 49. The respective arms 49 may be permanently hinged to the tubular body member 46, via bracket 54, or can be removably secured thereto by thumb screws, as known in the art. In the operating mode, the respective arms 49 are pivoted into an aligned relationship, then secured to the sides 56 of the door by cooperating hook ends 58. Above said pivoting arms 49, a cylindrical bracket 60 mounts a rotating pulley 62. In close proximity to the cylindrical bracket 60 is the open cable guide 48.

To accomplish a suitable exercising regimen with the device 10 of this invention, a cord or cable 64, having a hand grip 66 at one end, is provided. The free or opposite end 68 of the cable 64 includes a hook 70 to be temporarily secured by eyelet 72 on said sleeve 36. In assembling the device 10, the three cylindrical components 12, 28, 44 are telescopically engaged, as seen in FIG. 1, and removably secured along the top 18 and sides 56 of an appropriate hinged door. Thereafter, the free end 68 of the cable 64 is fed sequentially around the pulley 62, through the cable guide 48, thence around pulley 26, and finally secured to eyelet 72 by means of hook 70. In this mode, exercising may begin.

Figure 3:
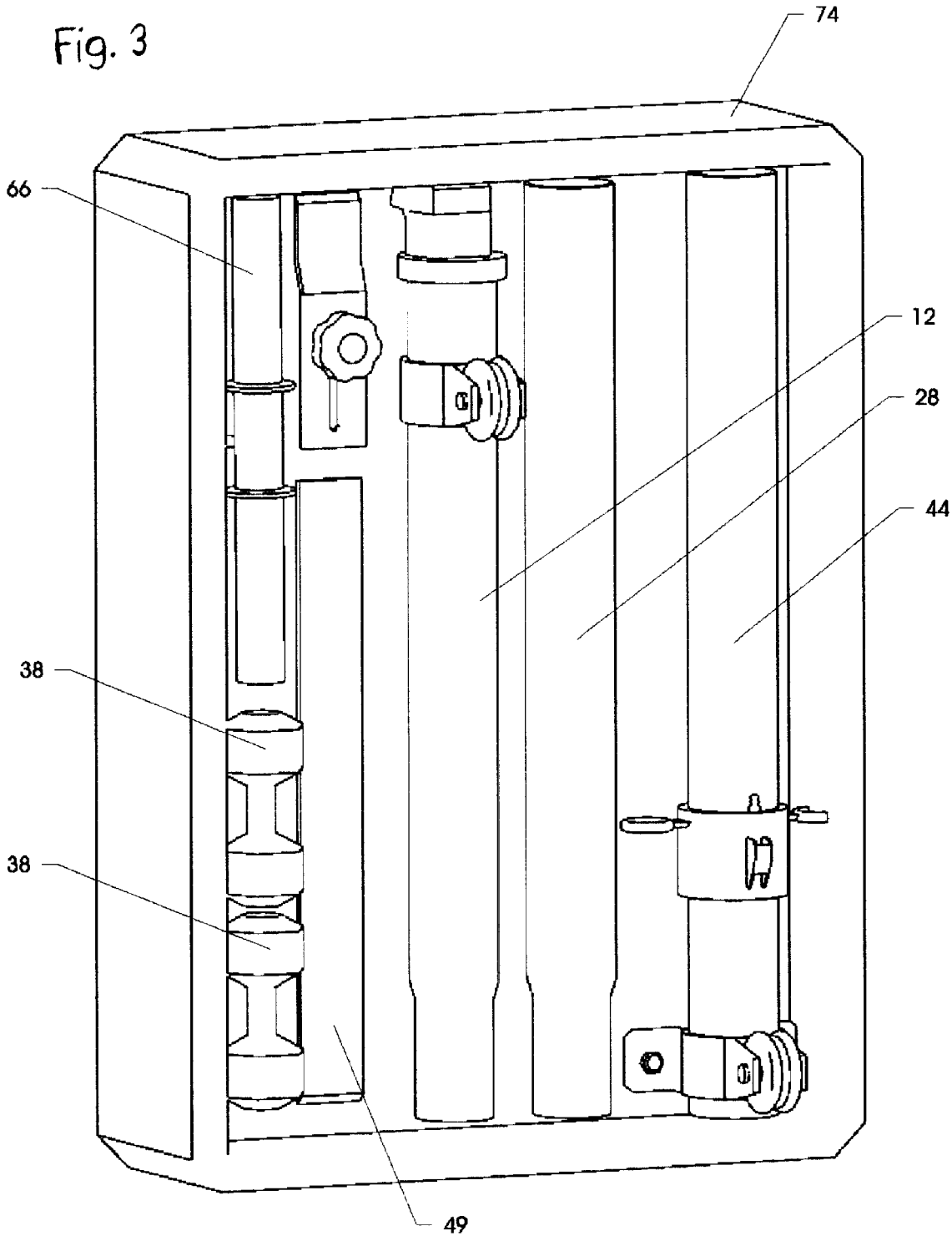
FIG. 3 is a perspective view of the components for the device of this invention nestable in a convenient carrying case or kit.

Upon completion of one's exercising regimen, should one wish to transport the device to another location, such as taking same on a trip or vacation, a convenient carrying case 74 or kit may be provided, see FIG. 3. Disassembly of the device 10 can be accomplished just as easily as the assembly operation. That is, the assembly operation described above is simply reversed. In any case, the case 74, generally rectangular in shape, with preferred dimensions of about (18) inches in width, (25) inches in height, and (3) to (4) inches in thickness, with a suitable handle 76, as known in the art. Within the case 74, the various components may be nestled therewithin, essentially in side-by-side relationship, as shown in FIG. 3.

It is recognized that changes, modifications, and variations may be made to the exercising device of this invention, particularly by those skilled in the art, without departing from the spirit and scope thereof. Accordingly, no limitation is intended to be imposed thereon except as set forth in the accompanying claims.

What is claimed is:

1. A personal and portable exercising device that is readily assembled, disassembled and transported to selected sites for mounting to a hinged door having a top and parallel sides, said device comprising: three intermatable, cylindrical members, where the first and third said members each mount a rotatable pulley, a sliding weight member for vertical movement along said matable members, one end of said first member mounting a hooked end for engagement with said top of said door, said one end further including a flanged stop ring adjacent thereto to limit the vertical movement of said sliding weight, a first end of said third member mounting a pair of pivotal arms, with each arm having a free end and at least one of said arms being axially adjustable, where said free ends include a J-shaped configuration for removably engaging the respective said sides of said door, and a hand operable cable cooperating with said pulleys and said sliding weight member to effect vertical movement of said sliding weight member along said intermatable, cylindrical members.

2. The personal and portable exercising device according to claim 1, including hook means associated with said sliding weight member for removably securing weighted elements thereto.

3. The personal and portable exercising device according to claim 1, including a cable guide in proximity to said pulley mounted on said third cylindrical member.

4. The personal and portable exercising device according to claim 1, wherein said sliding weight member comprises a closed ring having a thumb screw extending through the wall to removably secure said ring to said second cylindrical member during a transporting mode for said device.

5. The personal and portable exercising device according to claim 1, wherein said pivotal arms are movable from a position adjacent to said third cylindrical member to a position perpendicular thereto.

* * * * *